US008091748B2

(12) United States Patent
Whitlaw

(10) Patent No.: US 8,091,748 B2
(45) Date of Patent: Jan. 10, 2012

(54) DRESSING AID

(76) Inventor: Grady L Whitlaw, Jackson, SC (US)

( * ) Notice: Subject to any disclaimer, the term of this patent is extended or adjusted under 35 U.S.C. 154(b) by 1055 days.

(21) Appl. No.: 12/002,943

(22) Filed: Dec. 19, 2007

(65) Prior Publication Data

US 2009/0039118 A1 Feb. 12, 2009

Related U.S. Application Data

(60) Provisional application No. 60/963,770, filed on Aug. 7, 2007.

(51) Int. Cl.
*A47G 25/80* (2006.01)

(52) U.S. Cl. ..... 223/111

(58) Field of Classification Search ..... 223/111–119; 2/323–334; 24/298–302
See application file for complete search history.

(56) References Cited

U.S. PATENT DOCUMENTS 3,604,604 A 9/1971 Ahn
3,623,487 A * 11/1971 Chiu ..... 450/43
3,860,156 A 1/1975 Lawrence
3,937,512 A 2/1976 Baughman
4,379,358 A * 4/1983 Wibrow ..... 24/136 R
4,966,316 A 10/1990 George et al.
5,687,889 A 11/1997 Liden
6,044,491 A 4/2000 Emery
6,427,252 B1 * 8/2002 Lewis et al. ..... 2/326
6,836,899 B1 * 1/2005 Glasmire ..... 2/52
2005/0205619 A1 * 9/2005 Morel ..... 223/111
2009/0039118 A1 * 2/2009 Whitlaw ..... 223/111

* cited by examiner

*Primary Examiner* — Gary L Welch
*Assistant Examiner* — Andrew Sutton
(74) *Attorney, Agent, or Firm* — Stephen R. Chapman

(57) ABSTRACT

A device to assist physically challenged individuals to don outer, lower-body clothing or simultaneously don undergarments and pants or a skirt. The device comprises a cord to which at least one pair of grips is attached at either end. The grips are attached to a garment and the cord pulled to move the garments over the legs, hips, and ultimately to the waist. In one configuration, the cord is passed through a hand piece which allows locking the cord, freeing free one or both hands to fasten buttons of zippers.

3 Claims, 10 Drawing Sheets

DRESSING AID

RELATION TO PRIOR APPLICATIONS

This application claims priority of U.S. Provisional Patent Application 60/963,770 filed Aug. 7, 2007 which provisional patent application is hereinto incorporated in its entirety, by reference.

FIELD OF THE INVENTION

The invention is directed generally to the field of devices to aid the physically challenged as a result of injury, illness, or the infirmities of aging to dress. Specifically, it is a simple device to assist a physically challenged individual in donning undergarments, pants, or-skirts when the individual is restricted in bending at the waist, or one or both knees.

BACKGROUND OF THE INVENTION

An individual for various reasons may be unable to bend to insert feet and legs into and through the leg openings of undergarments and pants or through a skirt, pull the garment into proper, comfortable position, and fasten the waist band of the garment. The inability to accomplish this seemingly simple, but very necessary task may be the result of temporary or permanent, limited flexibility of the lower back or knees.

For many elderly individuals, as well as others suffering from certain diseases and injuries, including an increasingly young population of injured military personnel, except for the physical challenges associated with lost flexibility in the back and knees and certain losses of mobility associated with such losses that are beyond the scope of this invention, a major need for assistance is in dressing. Devices to respond to this need are recognized as making a significant contribution to an individual's independence.

A wide variety of devices have been developed to assist physically challenged individuals in their daily lives. Dramatic improvements in wheel chairs and related mobility devices are well known, and beyond the scope of this invention. Devices that are variously described or otherwise classified as "reachers" certainly must be considered in view of the current invention.

Reachers commonly comprise a shaft of varying length with some type of "jaws" at one end that are operated by a manual trigger device at the other, handle end. Such devices are used effectively to retrieve items from the floor, tables, or shelves, and have been modified to assist an individual in putting on socks and shoes. Dressing aids, including the modified reachers noted above, have been developed for a variety of specific uses: long-handled shoe horns to help those that cannot easily bend from the waist; plastic sleeves to assist in putting on socks and stockings, frequently such devices includes a "pull-stick" to move the sock/stocking into position once it is positioned over the foot and ankle. Dressing sticks comprising a stiff shaft and soft "hook" at the opposite end of the grip area are used by some to help pull-up pants legs. Examples of a comprehensive array of dressing aids that are commercially available may be viewed by visiting www.sampsonspreston.com, or by examining the Sampsons Preston catalog.

Certain dressing aids and predecessor technology are the object of United States patents. Among early art is a "grab-stick," a shaft with pull action jaws to pick-up litter and a forerunner to "reachers" issued as U.S. Pat. No. 3,937,512 to Harold Baughman on Feb. 10, 1976. Also see U.S. Pat. No. 5,687,889 for a multipurpose dressing rod and reacher issued Nov. 18, 1997 to Douglas T. Liden.

Several patents involve technology specifically focused on putting socks or stockings on. See for example U.S. Pat. No. 3,604,604 issued Sep. 14, 1971 to Albert D. Ahn and U.S. Pat. No. 3,860,156 issued Jan. 14, 1975 to Ralph Lawrence.

In some instances, multiple uses are suggested as in the "shoe horn and cane" apparatus of U.S. Pat. No. 4,966,316 issued to Curtis L. George and Sandra L. George on Oct. 30, 1990. In other instances the use is very specific, such as the "body sleeve" of U.S. Pat. No. 6,044,491 issued to Sylvia N. Emory on Apr. 4, 2004 which is worn around the torso and attaches to undergarments and helps the individual don the undergarment then is unfastened and removed from the body.

Some commercially available technology is seemingly ultra-simple, such as the pair of used to join and hold an upper garment to a lower garment when dressing and fastening buttons and the like.

There remains room in the art for a device that will assist an individual with limited flexibility of the lower back or knees to don undergarments, pants or a skirt starting from a semi-reclining, sitting, or standing position.

SUMMARY OF THE INVENTION

A first purpose of the invention is a device that will assist individuals with limited flexibility to don undergarments, pants, or skirts.

A second purpose of the invention is a device that will allow an individual to use one or both hands to adjust or fasten a garment while holding the garment in a convenient position.

A third purpose of the invention is a device that tends to hold upper leg openings in undergarments and pants open for ease of initially positioning feet when donning the garment.

These and other purposes and advantages are accomplished by a device that in its simplest configuration comprises a length of connective material, cord or strap, to each end of which is attached one member of a pair of grip devices capable of grasping the waist band of pants or a skirt and holding the garment while it is drawn or pulled upward from the mid-point of the cord or strap from the floor over the feet, lower legs, and thigh to the hips of the individual donning the garment; the individual may start in a reclining, seated, or standing position, and if not standing must raise his/her hips to move the garment to the waist; the purposes are further satisfied and accomplished by a device in which the first member of a second pair of grip devices is secured to the cord or strap by a short connector piece of material to above the first member of the first pair of grip devices and the second member of the second pair of grips devices is similarly connected above the second member of the first pair of grip devices such that the two members of the second pair of grip devices are attached to the waist band of an undergarment and the two members of the first set of grip devices are attached to the waist band of pants or a skirt the undergarment is positioned "inside" of the pants or skirt and raised or positioned first such that the device may be used simultaneously to don undergarments and pants or a skirt; the purposes are further satisfied by a device in which the cord passes through a handle structure with an upper grip and two arm elements, and one half length of the cord is associated with each arm element with the mid-point positioned above the top of the handle such that the cord can be drawn upward through the handle structure pulling attached garments upward with it; a stay clamp is positioned on the cord encasing both halves of the cord below the center point and movable to secure the cord in position when it is drawn upward to a desired position, and a separate clamp element is attached to the handle element at one end of a connector piece of material to which at the opposite end a grip device is attached such that the handle structure with the cord held in any position can be secured to a shirt or other garment or fixed point to allow the use of both hands in fastening the garments and releasing the members of the first and second pairs of grips from the garments.

These and other purposes, features, and benefits of the invention will be better understood and appreciated by examination of the following descriptions, examples, and figures as well as examination of the appended claims.

EXAMPLES

Introduction

Figure 1:
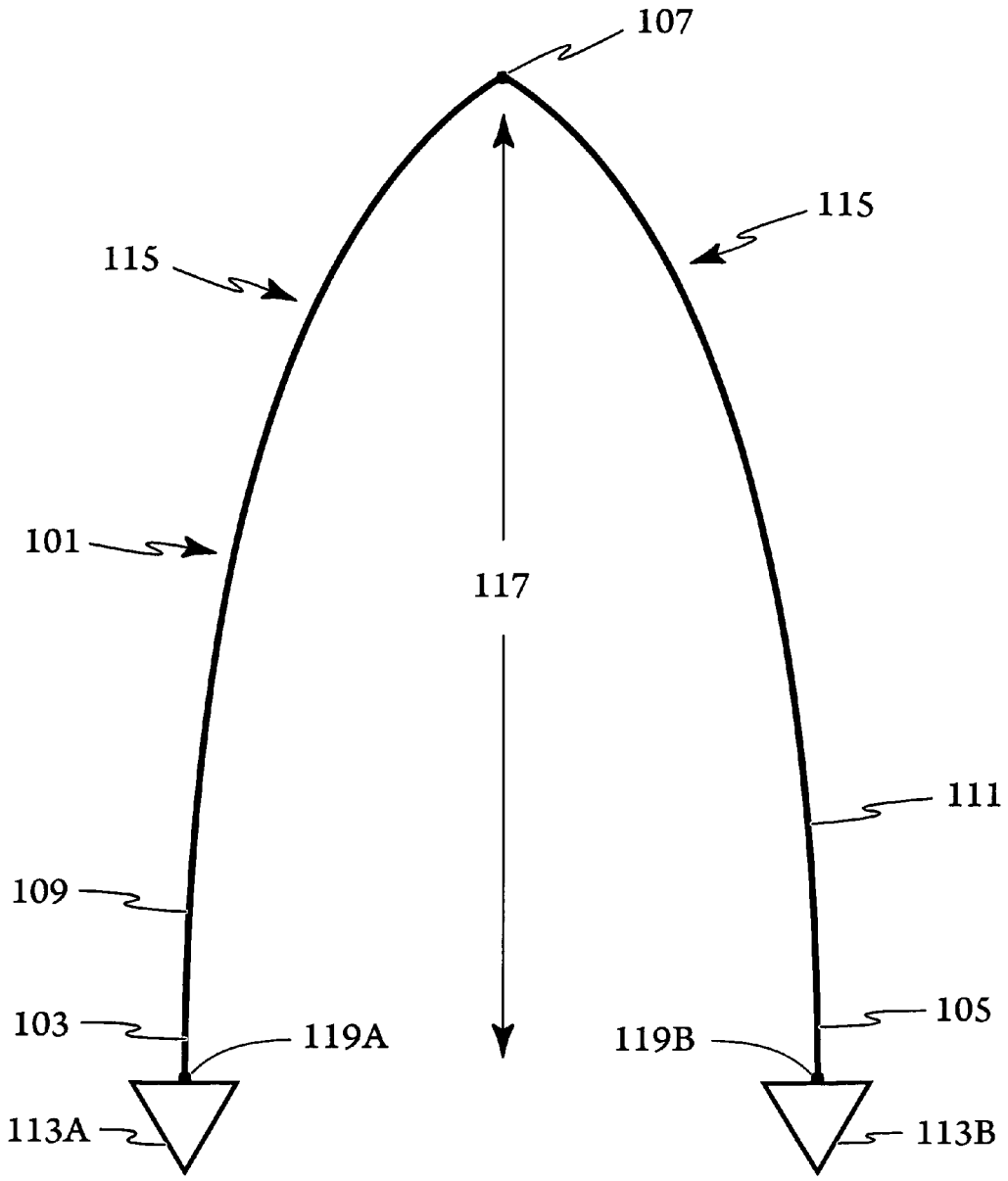
FIG. 1 illustrates the simplest configuration of the invention.
Figure 2:
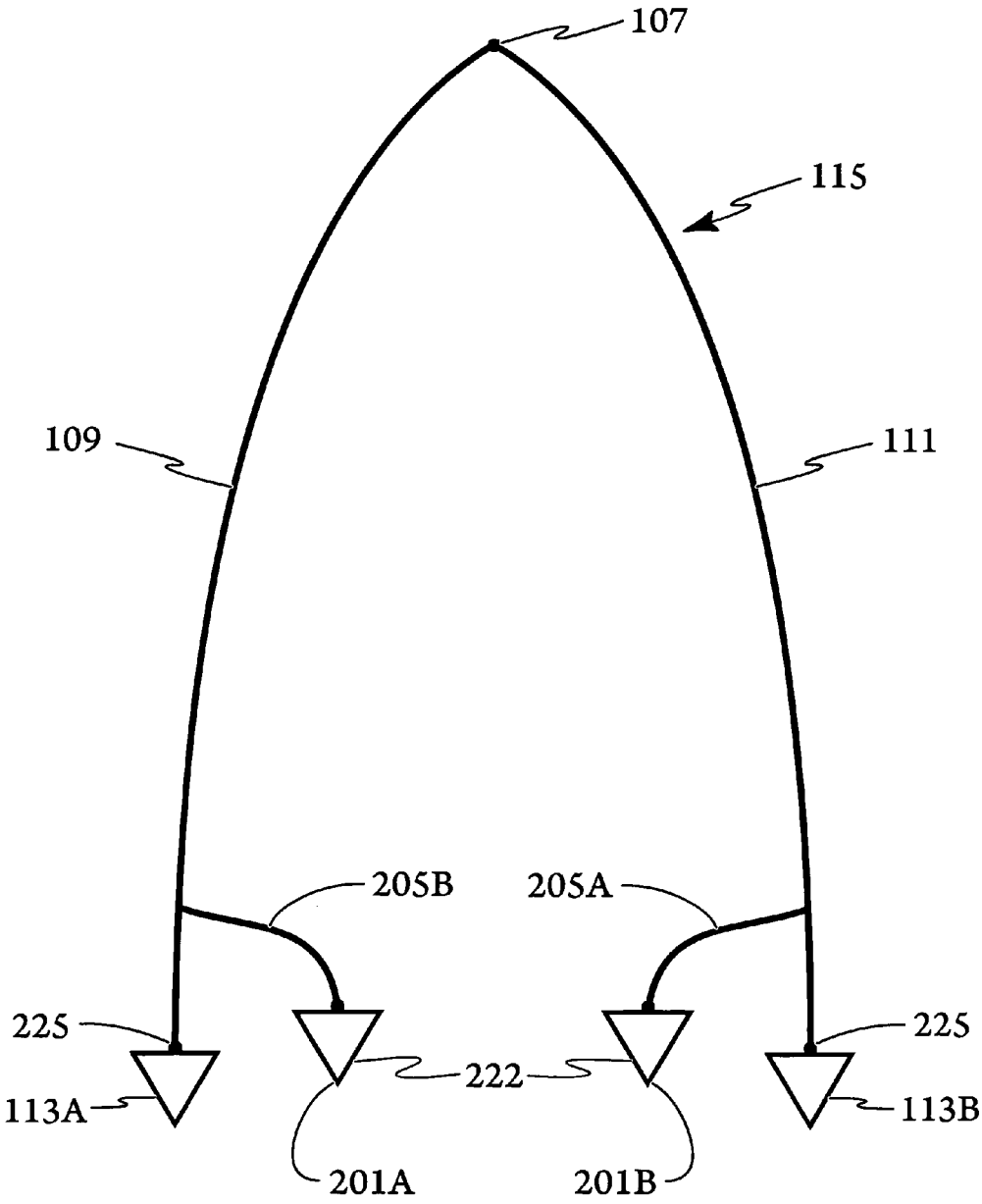
FIG. 2 shows the addition of a second pair of clamps added to the invention of FIG. 1.
Figure 3:
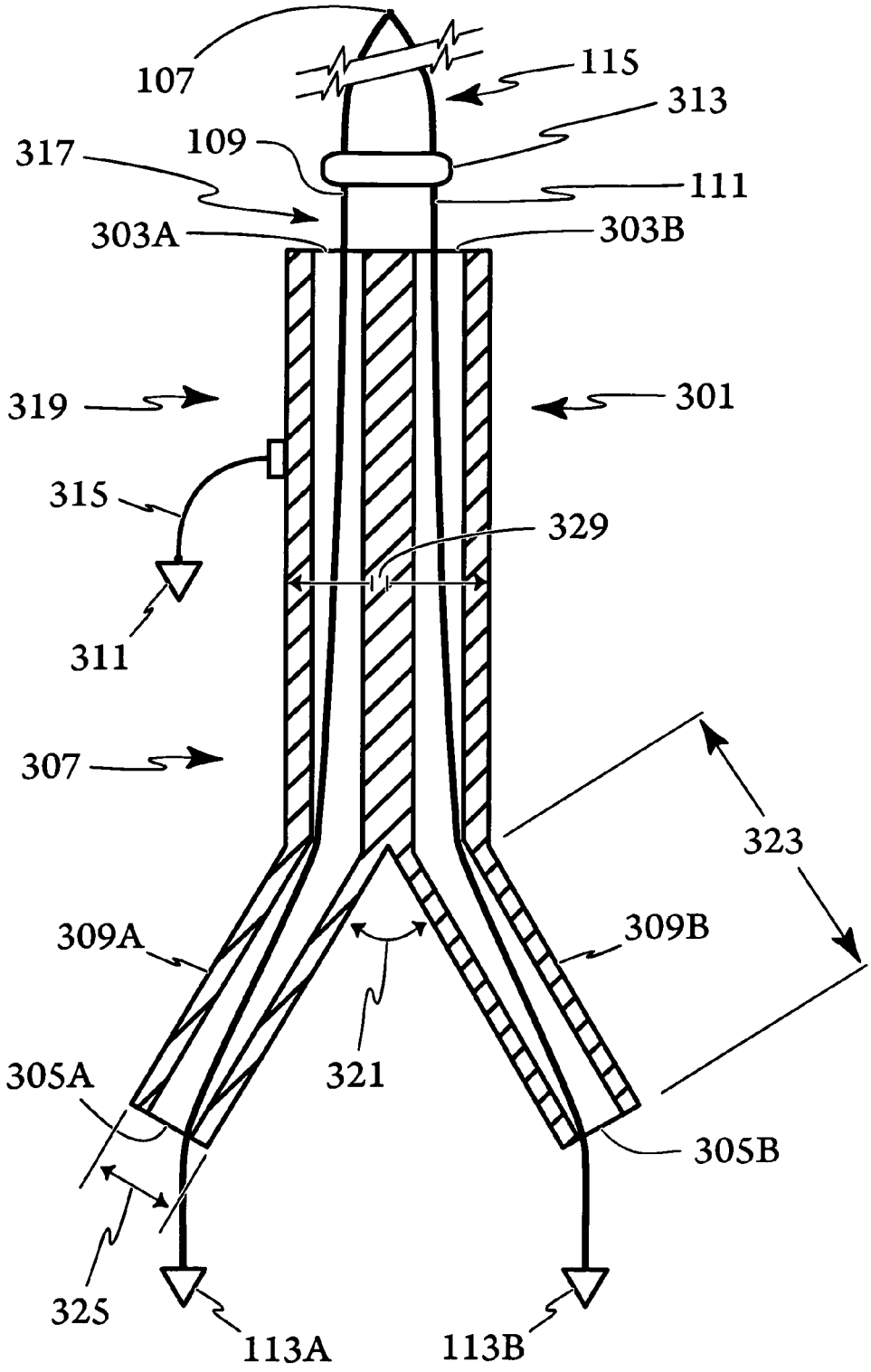
FIG. 3 illustrates the most complex configuration of the invention in which the cord element passes through a handle structure.

FIG. 1, FIG. 2, and FIG. 3 each illustrate an example of a configuration of the invention. Parts and elements in common among these, as well as all other figures, are numbered and identified when each is introduced and the reference number and description is the same for that part or element as it may be included in subsequent figures.

Figure 4B:
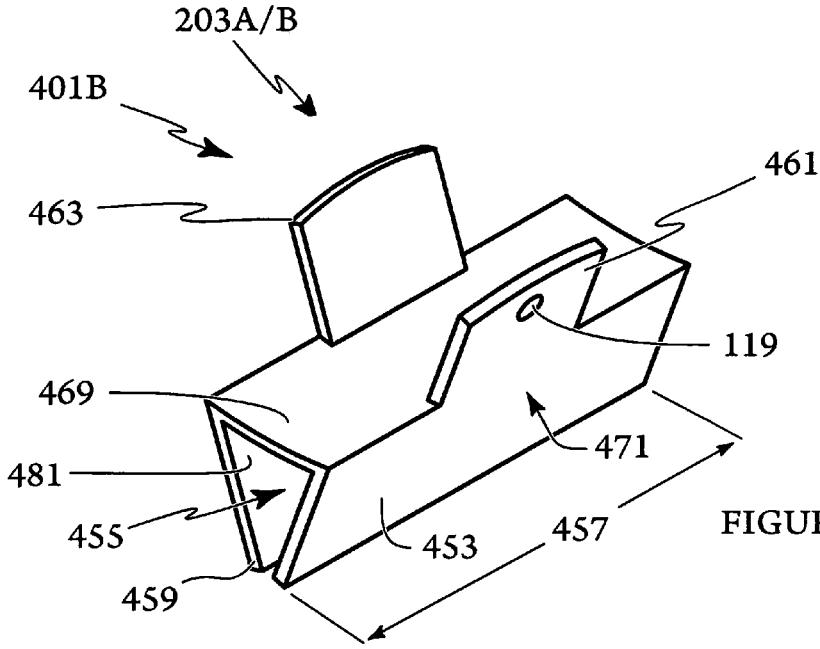
FIG. 4B illustrates a modified version of the grip device in FIG. 4A that the invention anticipates for use as the second pair of grip devices.
Figure 4A:
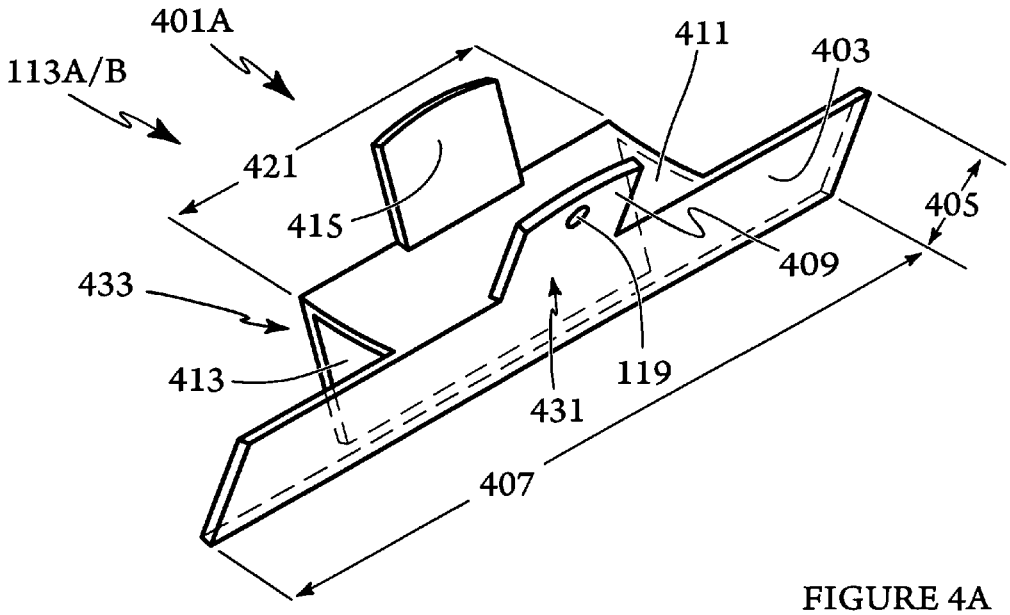
FIG. 4A illustrates one common type or configuration of a grip device that the invention anticipates for use as the first pair of grip devices.

FIGS. 4A and 4B illustrate one structure of a member of the first pair of grip devices 4A and the second pair of grip devices 4B. As one skilled in the art recognizes, a wide variety of grip devices is commercially available and all are anticipated and contemplated by the invention and appended claims. The various types and configurations of different types of grip devices as employed in the invention are functionally the same. For example of a clamp grip that does not require any spring but is anticipated see the "Tarp Clip" available from Ozark Trails USA.

Figure 5:
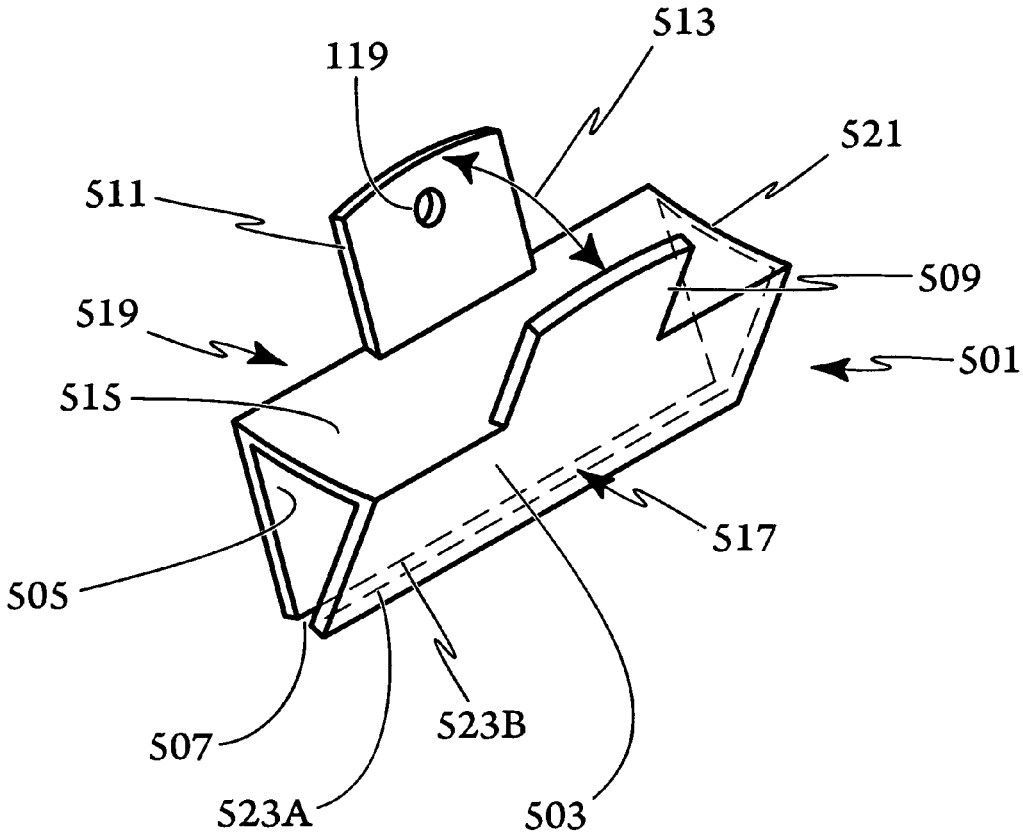
FIG. 5 illustrates some details of the basic structure of one of a variety of types of grip devices anticipated by the invention.

Because the grip devices is a basic element of the configurations of the best modes described in FIGS. 1, 2, and 3, the basic structure of the grip device as it is used in the invention is discussed first with reference to FIG. 5.

The simplest grip device of FIG. 5 shows the essential parts and features of any grip device as anticipated by this invention; certain of these features are amplified in the discussion of FIG. 4A and FIG. 4B.

With respect to FIG. 5, the basic grip device 501 comprises at least the following elements, parts, or areas. A compressible spring element 515 connects the first structural element 517 to the second structural element 519 along a line 521 such that when compressed, the grip jaw line 507 is closed. The first structural element 517 comprises a first structural unit 503 with a bottom edge 523A that comprises one half of the jaw region 507 and a first squeeze tab 509. Similarly the second structural element 519 comprises a second structural unit 505 with a bottom edge 523B that comprises the second half of the jaw region 507, and a second squeeze tab 511.

Functionally, when the first squeeze tab 509 is pressed inward direction 513 towards the second squeeze tab 511, spring 515 is compressed and the jaw line 507 is opened. The bottom, edges 523A and 523B of the first structural element 517 and the second structural element 519 separate. Material of the waist line of the garment to be worn is positioned in the opening. When the pressure on the first squeeze tab 509 and the second squeeze tab 511 is released, the jaw line 507 closes (spring 515 is decompressed) and the garment is securely held by the grip device until pressure is again exerted on the squeeze tabs. As noted above, some grip devices are available that operate by mechanical means other than a decompressable spring; the invention anticipates the use of such devices because the function of securing the garment as noted above and amplified below is satisfied.

Example 1

FIG. 1 illustrates the simplest configuration of the invention. The device 101 of FIG. 1 comprises a length of connective material, cord or strap material 115 with a first end 103, a second end 105, and a mid-point 107. The mid-point divides the connective material, cord or strap material, 115 into first half-length 109 and a second half-length 111. The length 117 of each half-length 109 and 111 is equal. The length 117 varies from 3 feet (1 meter) to over 5 feet (2 meters), or the overall length of the cord or strap 115 varies from less than 6 feet (2 meters) to about 10 feet (3 meters) although these values are reasonable examples, they do not constitute minimum or maximum values and are not limitations on the invention.

The device further comprises a first member of a first of a pair of grips 113A and a second member of a first pair of grips 113B. The first member of the first pair of grips 113A is firmly attached to the first end 103 of the cord or strap 115 and the second member 113B is similarly attached to the second end 105 of the connective material, cord or strap material 115.

The grip 113A/B may be secured to the cord or strap 115 at 103/105 in any of a variety of ways from tying the grip device, by any of a variety of small cable clamp devices known to those skilled in the art to a variety of adhesives, depending on the materials from which both the grip device and cord or strap are made. On any grip device the point of attachement of the coprd or strap to the grip device is represented by index number 119A and 119B in FIG. 1, and hereafter simply as 119 in reference to either or both points.

The cord or strap 115 may be natural, synthetic or any blend of materials commercially available and well known to those skilled in the art. Strength is not limiting, but minimum test should be approximately about 35 pounds (75 Kg) with an upper limit for convenience of material of 60 pounds (150 Kg). The cord for convenience in handling should be at least 0.25 inches in diameter (0.8 cm) to about 0.75 inch (1.9 cm), as a practical limit, but not a restriction on the invention. The strap material should have similar strength limits and range from about 0.50 to 1.0 inches (1.3 to 2.5 cm) in width.

Figure 6A:
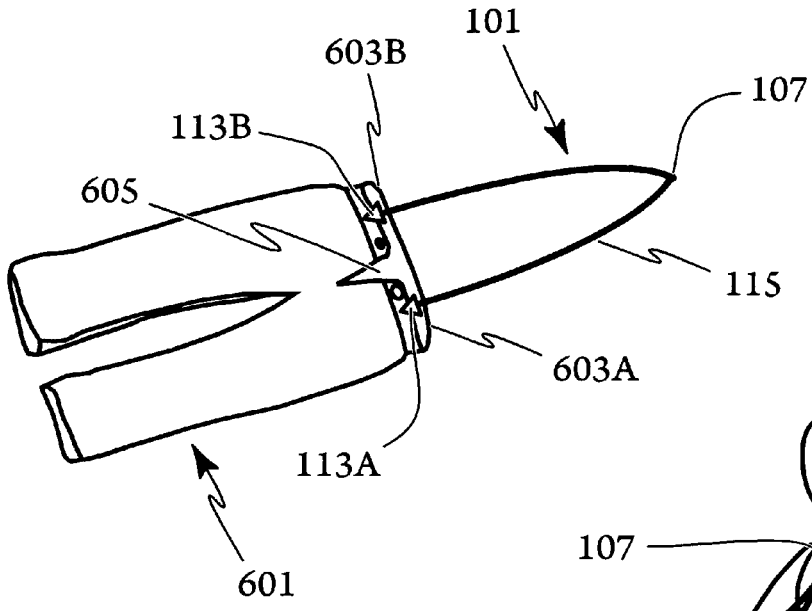
FIG. 6A illustrates an individual in a sitting position using the invention.
Figure 6B:
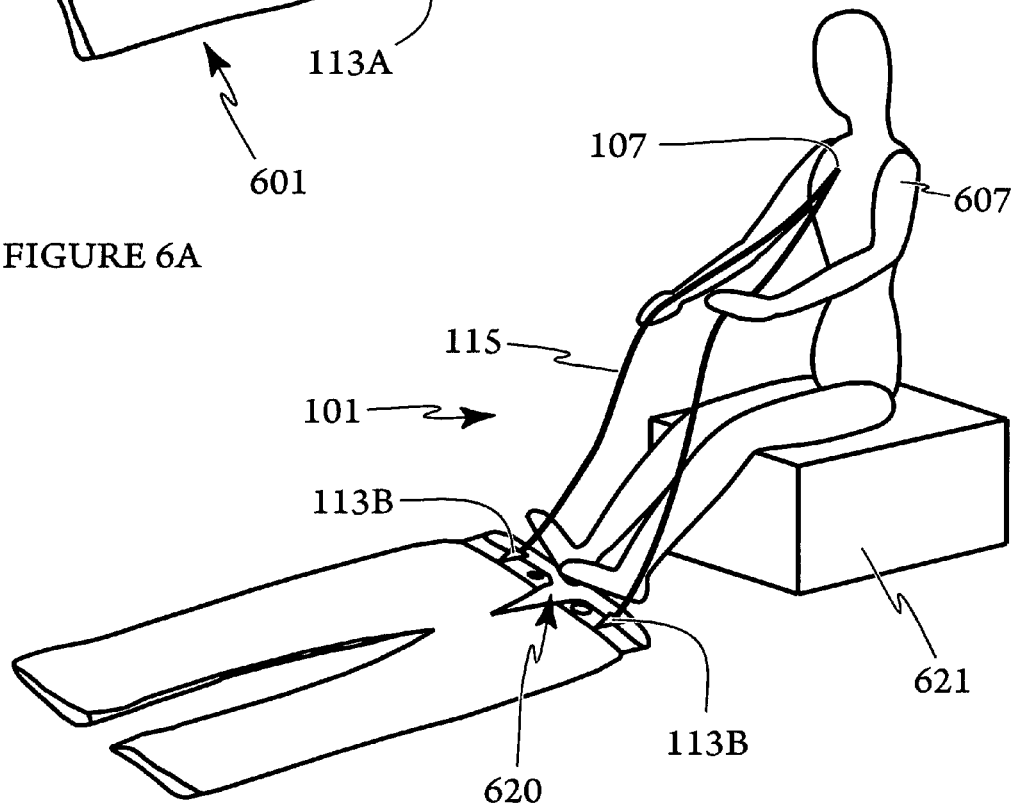
FIG. 6B illustrates the invention with a garment attached as it might be positioned for an individual to don the garment.

The function of the device is simply illustrated in reference to FIGS. 6A and 6B. First the device is attached by the grip devices to the waist band of the garment. Attachment should be near the fly or front opening of the garment. As seen in FIG. 6A, the garment 601 (pants as illustrated) is viewed face-up. The first member of the first pair of grip devices 113A is attached to the left side of the waist bands 603A, near the fly 605, and the second member of the first pair of grip devices 113B is attached to the right side of the pants near the waist line band 603B. The cord or strap 115 extends upward with the center point somewhat centered on the garment. FIG. 6B illustrates the device with an individual 607 seated 621.

As illustrated, the individual 607 has attached the device 101 to the garment and positioned the garment on the floor in front, face up as described for FIG. 6A, above. With feet positioned appropriately 620 at the top of the left and right leg and the cord or strap 115 grasped in both hands with the mid-point 107 generally centered, the cord 115 is pulled upward, and the pants are pulled up over the lower legs and thighs, by raising slightly, and continuing the upward pull, the pants are moved to the hips where they can be adjusted and fastened. Donning the garment requires only minimal bending of the back or knees.

Example 2

The simple configuration of FIG. 1 is modified in FIG. 2 to include a first member 201A of a second pair of grips and a second member 201B of the second pair of grips. The first member of the second pair of grips is attached to the cord or strap 115 by a short (1 to 3 inch or 2.5 to 7.5 cm) section of cord (or strap material) 205A positioned such that the bottom edge line 222 (jaw line) of the first member of the second pair of grips is positioned slightly above the top 225 first member of the first pair of grips. The second member of the second pair of grips 201B is similarly attached above the second member of the first pair of grips.

Functionally, the device is comparable to the function of the device as described for FIG. 1, except as the first step the first and second members of the second pair of grips are attached to or near the waist band of an undergarment generally as described for FIG. 1, and the first and second members of the first pair of grips are attached to the outer garment as previously described. In this manner, the undergarment is positioned inside in relation to the garment attached to the members of the first pair of grips.

Following the method described in the first figure, as the cord or strap 115 is pulled upward, the undergarment moves upward and can be positioned and the first and second members of the second grips released and removed from the undergarment and then the pants also positioned as desired and previously described.

Example 3

FIG. 3 illustrates an additional configuration of the device adapted primarily to the use of cord in which the cord passes through a hand piece body 307. As illustrated for simplicity, this configuration is illustrated only with a single pair of grips. One skilled in the art recognizes readily that a second pair of grips can be added following the discussion of FIG. 2 without changing the intent or complexity of the invention.

The hand piece 307 comprises a handle element 319 with length 350 and a first leg 309A and a second leg 309B. The legs are of equal length 323. The physical dimensions of the hand piece are not critical with respect to the function of the invention as described with respect to FIG. 1. The dimensions may vary quite widely more to accommodate individuals with limited manual dexterity. By way of example and not limitation, the diameter 329 of the handle element varies from about approximately 1 inch (2.5 cm) to 3 inches (7.5 cm). The length of the handle element varies from 4 to 8 inches (10 to 20 cm). The diameter 325 of the legs is equal and generally about one half the diameter 319 of the handle element. The length of the legs is equal and generally about one-half the length of the handle element 319 or from about 2 to 6 inches (5 to 15 cm), which dimensions are not a limitation. The legs are positioned uniformly in the horizontal plane from the vertical axis of the handle element (not indicated) with a total arc 321 of from 20 to 60 degrees but most commonly 30 to 40 degrees. The entire handle piece is manufactured from various plastics and composites, although other materials including wood and metal are not excluded.

The first 303A and second 303B guide channels are formed in the handle element 319 and traverse the handle element 319 and continue to traverse respectively the first 309A and second 309B legs. Thus each guide channel forms a continuous opening through the handle element and each leg with the channels ending respectively at the distil end 305A of the first leg and the distil end 305B of the second leg.

In this example, only cord is used to connect the several grip elements, although strap material is not excluded and this use does not constitute a limitation to the scope of the invention.

The first half-length of the cord 109 is inserted from the top 317 of the hand piece 307 passing through the first guide channel 303A and exiting at the distil end of the first guide leg 305A. Similarly, the second half length of the cord ill is passed through the second guide channel 303B exiting at the distil end of the second leg 305B. The first member of the first pair of grip devices 113A is attached to the first end of the cord 103 and the second member of the first pair of grip devices 113B is attached to the second end of the cord 105 as previously described. The mid-point of the cord 107 remains positioned above the top 317 of the hand piece 307.

The cord 115 comprises both the first half-length 109 and the second half-length 111 and extends as noted above the top 317 of the handle piece 307. The mid-point connecting both the first half piece and the second half piece is threaded through a simple mechanical stop device 313 that when open allows free movement of the cord and when closed or locked prevents movement of the cord through it. Such lock devices include various buckles and other similar devices readily available commercially and known to one skilled in the art.

A single, simple grip device 311 is attached by a short (approximately about 3 to 6 inches or 7.6 to 15 cm) piece of cord 315 by one end to the handle piece, and a grip device is attached to the opposite end.

In function, this configuration of the device is comparable to the device as described for FIG. 1 and FIG. 2. As previously noted, for simplicity only a single pair of grip devices is considered. As one skilled in the art recognizes, a second pair as described in relation to FIG. 2 can readily be added without modifying or changing the intent or scope of the invention.

The members of the pair of grips are attached to the garment and the garment is positioned on the floor, face up, in front of the individual as previously described. Feet are positioned properly at the leg openings. The individual holds the hand piece 307 by the handle element 319 in one hand and draws both half-lengths of the cord simultaneously upwards through the channels moving the garment upwards as previously described. When the garment reaches a convenient position, the individual can move the cord clamp device 311 to the top 317 of the hand piece 309, thereby preventing the cord and attached garment from pulling down or backward. To hold the device and attached garments in position, the device can be attached to an article of clothing, shirt or the like or to a fixed point on a dresser or wall hook installed for that purpose. With the handle element attached to a secured point and the cord locked in position both hands are freed to adjust the garments and fasten buttons or zippers, then release the grips. The same sequence is followed for a configuration in which a second pair of grips in used to don undergarments.

Example 4

The grip device described with respect to FIG. 5 is assumed for simplicity in the discussions of Example 1,2, and 3. The invention anticipates, but does not require possible modifications of that grip device. As previously noted, the invention also anticipates the widest variety of clamp devices that are adapted to serve the same functions as those described in the various examples as described in FIGS. 8A,B,C, and D.

The grip device 401A illustrated in FIG. 4A is modified from the generalized clamp device of FIG. 5, but retains all of the functional elements of that device. The device 401A could be the grips designated as the first and second members of the first pair of grip devices and associated with index numbers 113A and 113B in FIGS. 1,2, and 3. The grip device 401A comprises a first inner grip unit 431 comprising a first plate 403 with height 405 and length 407, and a first inner grip squeeze tab 409. The point of attachment to the cord or strap 119 is shown only for reference to other figures. A spring element 411 connects the first inner grip unit 431 to a second inner grip unit 433 comprising a second plate 413 with and length 421, and a second squeeze tab 415. The height of the second plate is the same as that of the first plate 405. The length 407 of the first plate 403 of the first inner grip unit 431 is greater than the corresponding length 421 of the second plate of the second inner grip unit. By way of example, but not limitation, the dimensions of the first plate 403 may be 4 to 6 inches (10 cm to 15 cm) in length 401 and 1.5 to 2.5 inches (3.8 to 6.4 cm) in height 405 excluding the squeeze tab 409. The corresponding dimensions for the second plate 413 may be 2 to 3 inches (2.5 to 3.8 cm) in length. The second plate 413 may have dimensions equal to the first plate 403 without altering the invention and such dimensions are anticipated by the invention.

In use, the grip device 401A is positioned on the garment such that the first plate 403 of the first inner grip unit is positioned on the inside of the garment (effectively against the individual) and the second plate 413 is positioned on the outside of the garment (effectively the garment separates the second plate 413 from the individual). The dimensions of the first plate tend to hold the garment open, thereby facilitating proper positioning of the feet before pulling the garment upward by the cord. Although other configurations of the grip unit may further facilitate this positioning, balance must be made between size and practicality and this facilitation.

FIG. 4B effectively reiterates much of FIG. 5 and is included here mainly to facilitate comparisons with the device 401A of FIG. 4A. The grip device 401B could be the grip devices designated as the first and second members of a second pair of grip devices indicated by 201A and 201B in FIG. 2. The device 401B of FIG. 4B could also be the single grip 311 of FIG. 3. The device 401B comprises a second device first inner grip unit 471 comprising a first plate 453 with length 457 and height 459, and a squeeze tab 461. A spring element 469 connects the second device first inner grip unit 471 to the second device second inner grip unit 455. Said second device second inner grip unit comprises a second plate 481 with length and height equal to that of the first plate 457 and 459, respectively and a squeeze tab 463.

One skilled in the art readily recognizes that the grip device described in FIG. 4A can be used in all applications of the invention as can the grip device described in FIG. 4B. Moreover, it is recognized that numerous other grip, clamp, and clip devices could be adapted to the uses described in FIGS. 1,2, and 3, all of which are anticipated and incorporated into the invention.

Example 5

Note in the following, reference numbers indicating pieces, parts, and elements described in FIGS. 1,2, and 3 are retained in FIG. 7 when the piece, part, element, or function is identical to that previously described and indicated on one of the above referenced figures.

Figure 7:
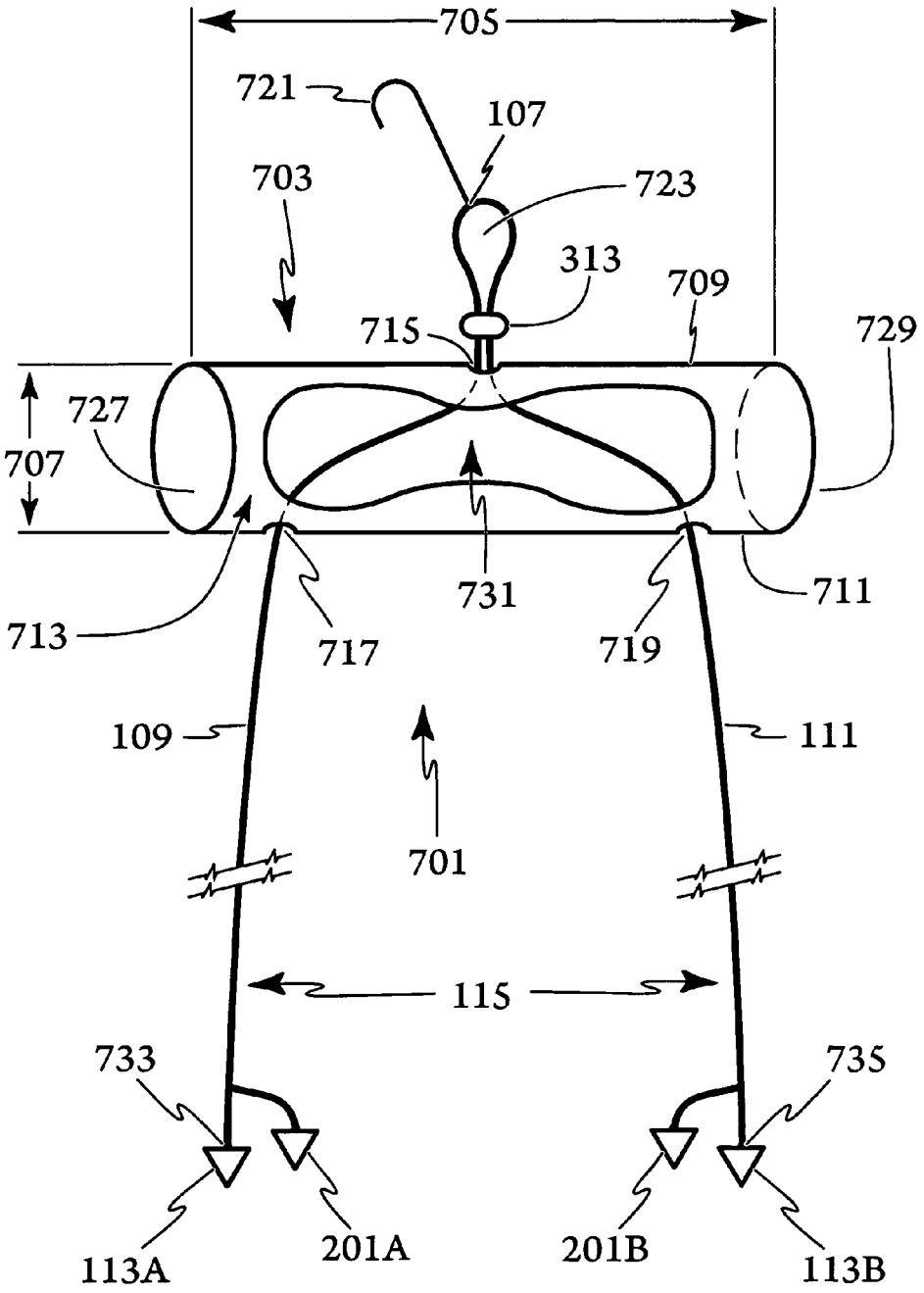
FIG. 7 illustrates an alternative form of the handle structure illustrated in FIG. 3.

FIG. 7 illustrates an alternative hand piece 701 to the hand piece body 301 previously described. The alternative hand piece 701 comprises a single tube element 703. The single tube element 703 has a length 705 an inside diameter 707, and an open longitudinal core 731 defined and limited by the tube wall 713.

The tube element varies in length from about approximately 4 inches to 18 inches (10 cm to 46 cm) preferably from 6 to 10 inches (15 to 25 cm). The inside diameter of the tube varies from 1 to 3 inches (2.5 to 7.5 cm). Note, the above length and inside diameter dimension are exemplary and do not constitute limitations on the invention. The tube may be fabricated from any rigid, light weight material including metals plastics, and composite materials.

A top opening 715 traverses the tube wall 713 at the midpoint of the upper longitudinal line 709 of the single tube 703. The first bottom opening 717 and the second bottom opening 719 traverse the wall 713 at a distance respectively from the first end of the single tube 727 and the second end of the single tube 729 on the lower longitudinal line 711. The lower longitudinal line 711 is diametrically opposite the upper longitudinal line 709 on the outer surface of the single tube 703. Both lines are for reference only with respect to positioning or locating the top opening 715 and the first and second bottom openings 717 and 719, respectively. The diameter of the top opening and of the first and second bottom openings is variable. The top opening must be large enough to allow free simultaneous passage of both the first half 109 and the second half 111 of the cord material, and the first and second bottom openings must allow free passage respectively of the first half 109 or the second half 111 of the cord material.

A length of the cord material 115 is positioned within the open core 731 of the single tube 703 such that the end 733 of the first half-length extends downward through the first bottom opening 717, and the end of the second half-length 735 extends downward through the second bottom opening 719. The midpoint 107 extends upward through the top opening. The first half-length 109 and the second half-length 111 are joined for a short distance at a point below the midpoint 107 to form a loop 723. A hook element 721 may be threaded onto the cord material 115 inside the loop 723. A mechanical stop device device 313 allows the passage of the cord material to be controlled as previously described.

Members of the first pair of grips 113A and 113B and the second pair of grips 201A and 201B, respectively, are positioned as previously illustrated and discussed with respect to FIGS. 1,2, and 3. Functionally members of the first pair of grips, 113A and 113B and of the second pair of grips 201A and 201B are attached as previously described. In terms of application, the single tube is used in a manner effectively the same as the hand piece described by FIG. 3 and Example 3.

The cord material and grips can be folded into the open core of the single tube and caps positioned of the first end 727 and second end 729 of the single tube for convenient storage.

Example 6

The preceding descriptions, examples, and figures are for illustrative purposes only and do not constitute or suggest limitations on the invention of the interpretation and construction of the appended claims which should be accorded the broadest interpretation consistent with the full scope of the disclosure and teachings hereof.

FIGS. 1,2, and 3 illustrate, and the related text discusses a grip connected to the end of the cord or strap that connects the garment to the dressing aid. FIGS. 4A,4B and 5 describe a spring powered grip in detail. Throughout the disclosure, reference is made to other types of grips. The device of this invention anticipates grips to include any device or mechanism attached to a cord and is adapted to being releasably connected to a garment. By way of further illustration, but not as a limitation, a variety of such devices is illustrated in FIGS. 8A-D; FIG. 8E illustrates a stop device referenced with respect to FIG. 3 and FIG. 5.

Figure 8A:
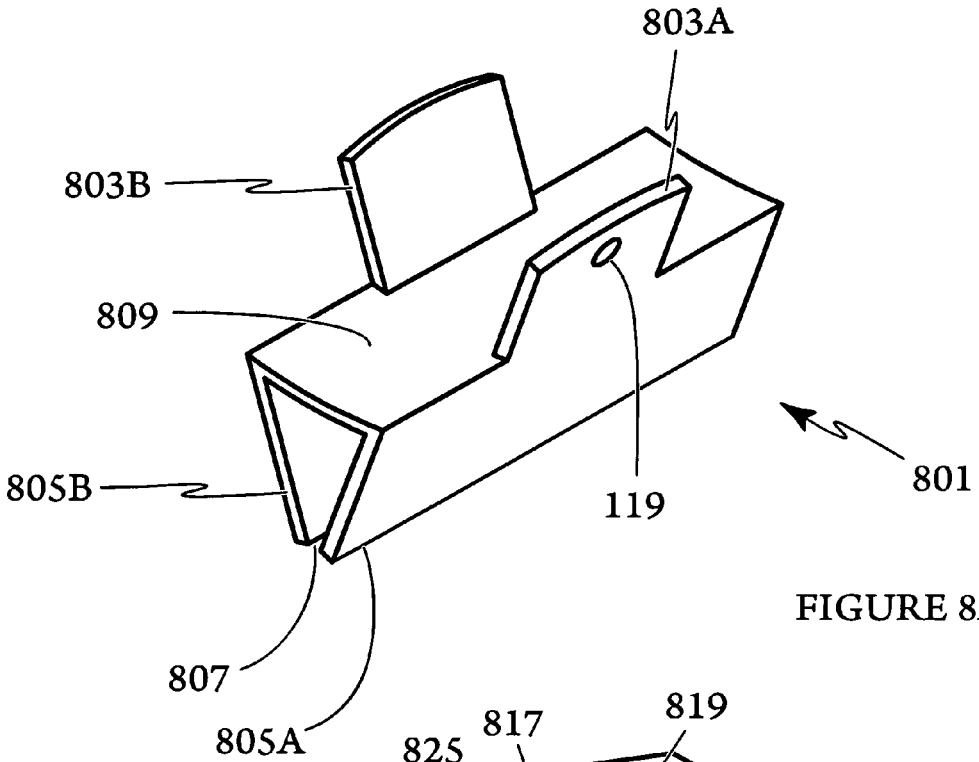
FIGS. 8A-D illustrate various types of grip devices anticipated by the invention.

The first grip 801 illustrated in FIG. 8A is a spring closing type typical of a traditional "clothes pin" designed to attach laundry to a clothes line. This device is described in detail in FIGS. 4A,4B, and 5. Pressure inward on the tabs 803A and 803B depress the spring element 809 thereby separating edges 805A from 805B and opening grip area 807. Material inserted into grip area 807 is held until pressure is exerted and the hold released.

Figure 8B:
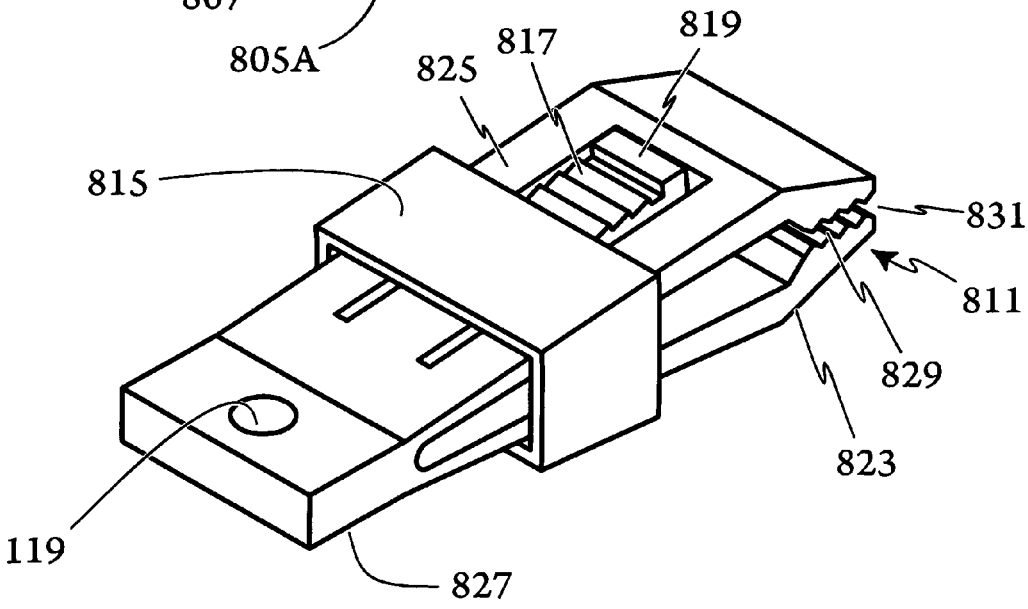

FIG. 8B illustrates a mechanical clamp device 811. The bottom piece 823 and top piece 825 are connected at the proximal end 827. The clamp device (grip) is connected to the cord at opening 119. The top piece 825 and bottom piece 823 are separated by spring action of the material from which they are fabricated. A collar 815 circumscribes the top and bottom pieces (825 and 823, respectively) and limits the extent (width) of opening of the distil end between these pieces. The inner surfaces of both the top 825 and bottom 823 pieces are toothed 829 to grip material. When collar 815 is moved towards the distil end 831, lock tab 817 is depressed as secured in a locked position by collar 815 such that the top 825 and bottom pieces are forced together to grip material as opening 813 is closed. Depressing release point 819 allows the collar 815 to be moved back to an initial position thereby opening the grip.

Figure 8C:
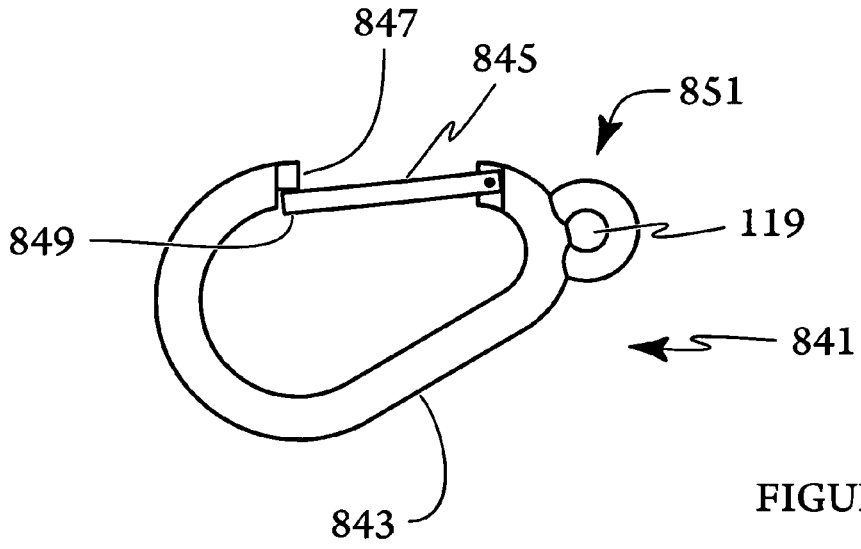
Figure 8D:
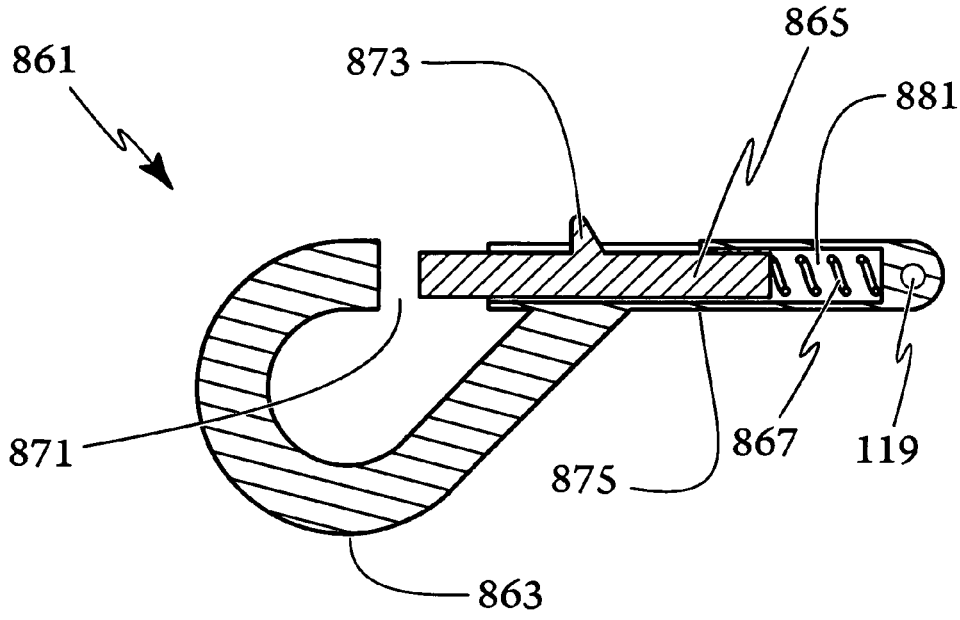
Figure 8E:
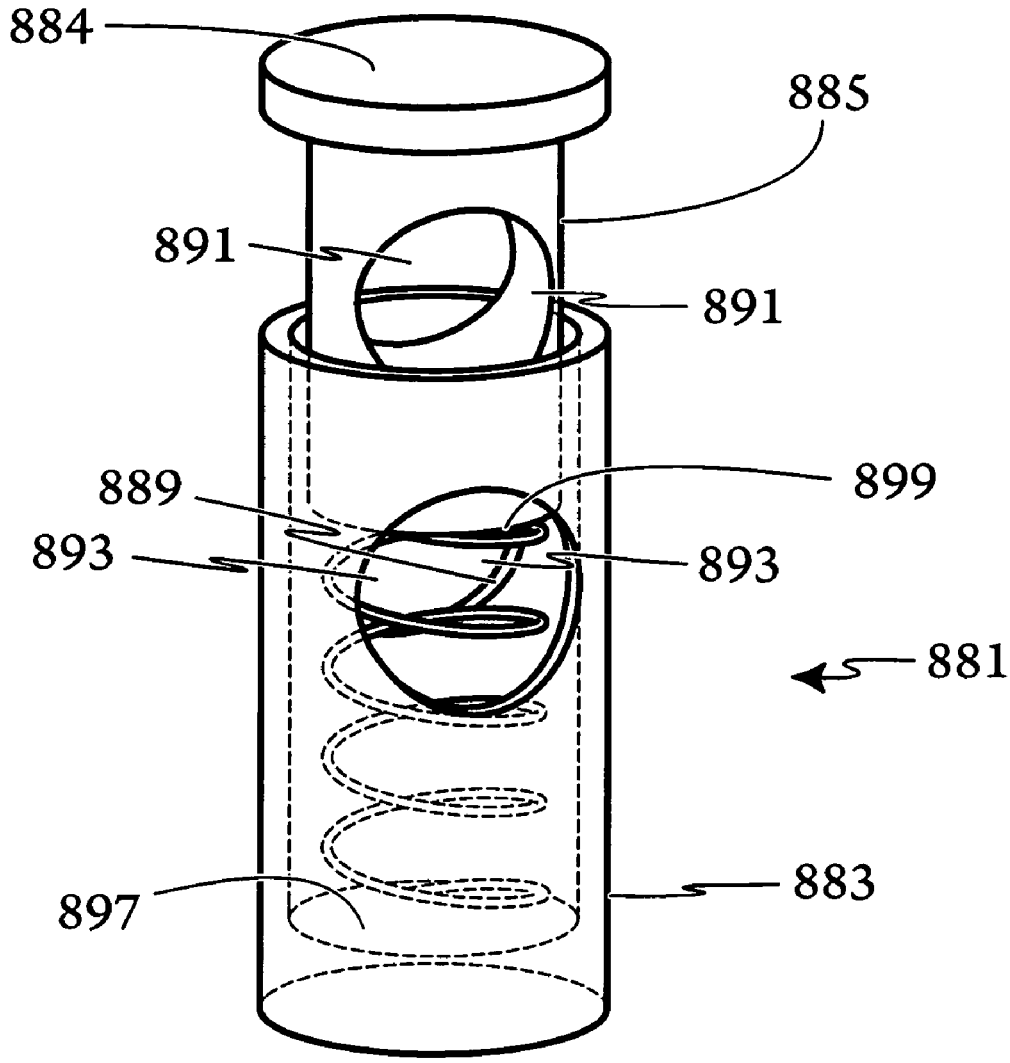
FIG. 8E illustrates a suitable cord stop device.

A third alternative is illustrated in FIG. 8C. The grip 841 comprises a "J" shaped frame piece 843 with a spring element 845 attached at the proximal end 851 near the point of attachment 119 for the cord. The spring element 845 is positioned below the distil end 847 of the frame piece 843. Inward pressure on the spring piece 845 opens the grip area 849; releasing the pressure closes it. Opening and closing the grip area 849 allows a garment to be held and then released. In an alternative mode, the spring piece 845 is omitted and the "J" piece is attached directly to the garment, at a belt loop or button hole, for example.

A fourth example is a mechanical latch device 861 comprising a "J" shaped frame 863 with a piston 865 positioned in a slot 881 on the shank portion 875 of the latch device 861 with a spring 867 forcing the piston forward. Pressure back on tab 873 forces piston 865 back opening grip area 871 to secure garment material when pressure is released and piston moves forward, closing grip area 871.

FIG. 8E illustrates an effective mechanical stop device that is appropriate for the invention, but is not a specific limitation. The mechanical stop device 881 comprises an outer barrel 883 and an inner barrel 885. Members of the first pair of cord passage apertures 893 are positioned on opposite sides of the outer barrel, and members of the second pair of pair of cord passage apertures 891 are positioned on opposite sides of the inner barrel 885. The inner barrel 885 is partially inserted into the outer barrel 883 and rests on a spring 889 that rests on the inside bottom 897 of the outer barrel and the outside surface 899 of the inner barrel. When the spring is depressed by pressure on the inner barrelcap 884, the members of the two pairs of cord passage apertures 981 and 893 align and cord can pass freely; when pressure is released, the pairs of apertures are not aligned and movement of the cord in prevented; the cord is locked.

The above described stop device is provided for illustrative purposes only; the invention anticipates all other types of devices that accomplish a comparable function.

The invention anticipates use by individuals of varying ages and potentially with widely varying limitations in manual dexterity, in addition to the previously noted lack of flexibility in the back, hips and legs. As a result, a wide variety of grip devices and stops is logically part of the invention, although only a reasonable sample has been presented. Thus the samples are clearly to be considered illustrative, not limitations, and the appended claims should be afforded the widest latitude in interpretation.

That which is claimed is:

1. A device to assist physically challenged individuals to don inner and outer, lower-body garments comprising:

a length of cord wherein said length of cord has a first end, a second end, a first half-length, a second half-length, and a mid-point;

a hand piece body, said hand piece body comprising a handle element, a first leg, and a second leg, wherein said body element has a first guide channel traversing said hand piece from the top of said hand piece through said hand body piece to the end of said first leg and a second guide channel traversing said hand piece body from the top of said hand piece body to the distal end of said second leg; a portion of the first half-length of the cord passes through said first guide channel and the first member of a pair of grip devices is attached to said first end of said cord, and a portion of the second half-length of said cord passes through said second guide channel and the second member of said pair of grip devices is attached to said second end of said cord; a cord mechanical locking device is positioned on the cord extending above the top of the hand piece body.

2. A device to assist physically challenged individuals don under and outer lower body garments comprising:

a single tube wherein said single tube comprises a length, and an inner diameter and further wherein said single tube comprises an upper longitudinal line and a lower longitudinal line, and still further wherein said tube comprises an open core, said open core being defined and limited by a wall;

a top opening traversing said wall at the longitudinal midpoint of said upper longitudinal line, and a first bottom opening and a second bottom opening, each of said first and said second bottom openings traversing said wall at a point on said lower longitudinal line a distance from the first end and the second end, respectively, of said single tube;

cord material positioned in said open core of said single tube such that the first half of said cord material extends downward from said first bottom opening of said single tube and the second half of said cord material extends downward from the second bottom opening of said single tube, and further wherein the center point of said cord material extends upward from said top opening and forms the apex of a loop of said cord material;

the first and second members of a pair of grips are securely attached to the first and second ends, respectively, of said cord material.

3. The device of claim 2 wherein the fully extended first half-length and second half length of said cord, including all grips attached to said first half-length and said second half-length are folded into said open core of said single tube, and the first end and the second end of said single tube are closed by individual caps.

* * * * *